US008727193B2

(12) United States Patent
Oelzant

(10) Patent No.: US 8,727,193 B2
(45) Date of Patent: May 20, 2014

(54) DETACHABLE BELT BUCKLE

(71) Applicant: Eveline Oelzant, Aalfang/Amaliendorf (AT)

(72) Inventor: Eveline Oelzant, Aalfang/Amaliendorf (AT)

( * ) Notice: Subject to any disclaimer, the term of this patent is extended or adjusted under 35 U.S.C. 154(b) by 0 days.

(21) Appl. No.: 13/845,956

(22) Filed: Mar. 18, 2013

(65) Prior Publication Data

US 2013/0214021 A1 Aug. 22, 2013

Related U.S. Application Data

(63) Continuation of application No. PCT/AT2011/000373, filed on Sep. 13, 2011.

(30) Foreign Application Priority Data

Sep. 17, 2010 (AT) ..... A 1549/2010

(51) Int. Cl.
*A45C 15/00* (2006.01)

(52) U.S. Cl.
USPC ..... 224/576

(58) Field of Classification Search
USPC ..... 224/576
See application file for complete search history.

(56) References Cited

U.S. PATENT DOCUMENTS

| | | | | |
|---|---|---|---|---|
| 3,986,233 | A | 10/1976 | Stone, Jr. | |
| 4,113,157 | A | 9/1978 | Woodbury | |
| 4,437,598 | A | 3/1984 | Hull | |
| 4,536,889 | A * | 8/1985 | Taylor et al. | 2/160 |
| 4,570,308 | A * | 2/1986 | Weisgerber | 24/163 K |
| 4,753,377 | A * | 6/1988 | Poluhowich | 224/163 |
| 4,790,435 | A * | 12/1988 | Trusty | 206/39.5 |
| 5,357,638 | A * | 10/1994 | Mayzel | 2/312 |
| 5,358,141 | A * | 10/1994 | Carlson et al. | 221/185 |
| 5,379,493 | A | 1/1995 | Wu | |
| 6,886,724 | B2 * | 5/2005 | Hung | 224/163 |
| 2006/0249524 | A1 * | 11/2006 | Headrick | 221/45 |
| 2007/0017999 | A1 | 1/2007 | Liu | |
| 2008/0024976 | A1 | 1/2008 | Hardson et al. | |
| 2008/0073392 | A1 | 3/2008 | Liu | |
| 2008/0223889 | A1 * | 9/2008 | Rossell et al. | 224/222 |
| 2009/0095783 | A1 * | 4/2009 | Price | 224/576 |
| 2013/0119096 | A1 * | 5/2013 | Morgan et al. | 224/148.1 |

FOREIGN PATENT DOCUMENTS

| | | |
|---|---|---|
| DE | 76 32 114 U1 | 1/1977 |
| DE | 28 16 376 | 7/1979 |
| DE | 94 19 242 U1 | 3/1995 |
| WO | WO 2005/025361 A1 | 3/2005 |
| WO | WO 2010/012847 A1 | 2/2010 |

* cited by examiner

*Primary Examiner* — Brian D Nash
(74) *Attorney, Agent, or Firm* — Muncy, Geissler, Olds & Lowe, P.C.

(57) ABSTRACT

A belt buckle, which is to be attached to a belt strap and which can be detached without tools and which has an integrated container for check cards, identify cards, a driver's license, and the like, comprising a base plate fastened to a belt strap end, wherein said frame is covered by means of a closing plate, in particular a decorative plate, on the side of the frame facing away from the base plate. A closing element that covers the open upper face of the frame can be slid onto the open upper face of the frame. The closing element reaches behind the belt strap end by means of the belt strap securing tab of the closing element attached to the rear side and reaches over the closing plate on the front face. The closing place can be replaced and is designed such that a connecting element for accommodating an ornamental plate is arranged on the front face of the closing plate.

4 Claims, 2 Drawing Sheets

DETACHABLE BELT BUCKLE

This nonprovisional application is a continuation of International Application No. PCT/AT2011/000373, which was filed on Sep. 13, 2011, and which claims priority to Patent Application No. A 1549/2010, which was filed in Austria on Sep. 17, 2010, and which are both herein incorporated by reference.

BACKGROUND OF THE INVENTION

1. Field of the Invention

The invention relates to a belt buckle that can be detached without tools and has an integrated container for debit cards, identity cards, driver's license, and the like.

2. Description of the Background Art

Different forms of such containers are known. DE 9419242 U1 (which corresponds to U.S. Pat. No. 5,379,493) describes a belt buckle onto which replaceable ornamental face plates can be slid. The disadvantage of this type of design is that no possibility for storing debit cards and the like is provided. The belt buckle disclosed in DE 76 32 114 U1 has the same drawback. Moreover, replacement of an ornamental plate is not possible. A carrier bag, which can be attached to be carried on a belt, is disclosed in US 2008/0073392 A1. The fact that the container cannot be interchanged with another belt is a disadvantage. The same disadvantage also applies to the metal box described in US 2007/0017999 A1. The buckle described in WO 2005/025361 A1 can not be interchanged either with another belt, whereby an ornamental plate cannot be attached onto it. The receptacle disclosed in U.S. Pat. No. 4,113,157 A also has these two disadvantages.

SUMMARY OF THE INVENTION

It is therefore an object of the invention to improve a container of the aforementioned type so that the mentioned disadvantages no longer apply. This is attained according to the invention in that a frame open at the top is provided on a base plate attached to a belt strap end, which frame is covered by a closing plate, in particular by a decorative plate, on its side facing away from the base plate. It has proven advantageous thereby if a closing element covering the open upper face of the frame can be slid onto it, which element reaches behind the belt strap end by its belt strap securing tab, attached to the rear side, and reaches over the closing plate on the front face. Moreover, it proves advantageous if the closing plate can be replaced and that a closing plate is provided on whose front face a connecting element for accommodating an ornamental plate is arranged.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
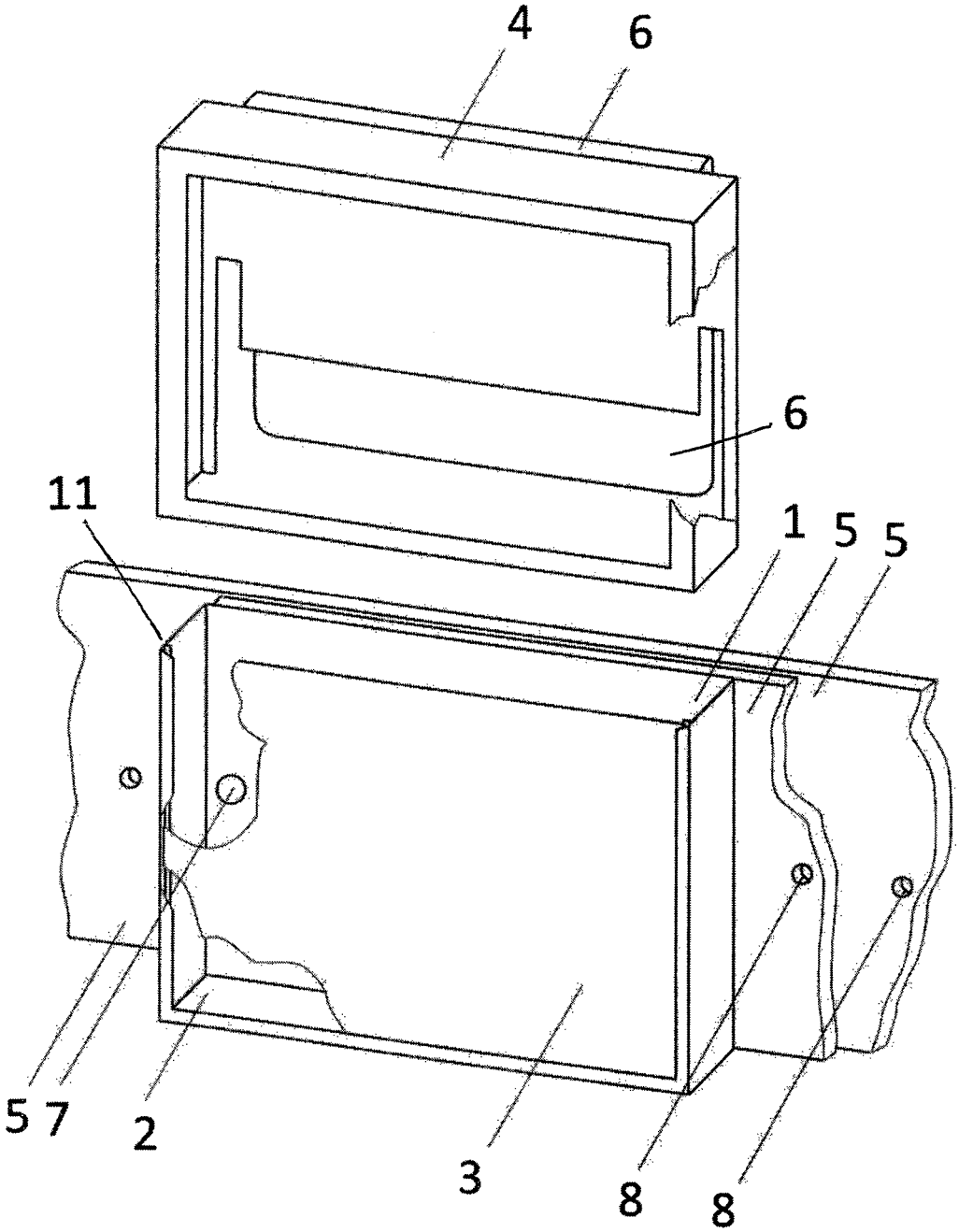
FIG. 1 illustrates in an axonometric illustration a container in an open state.
Figure 2:
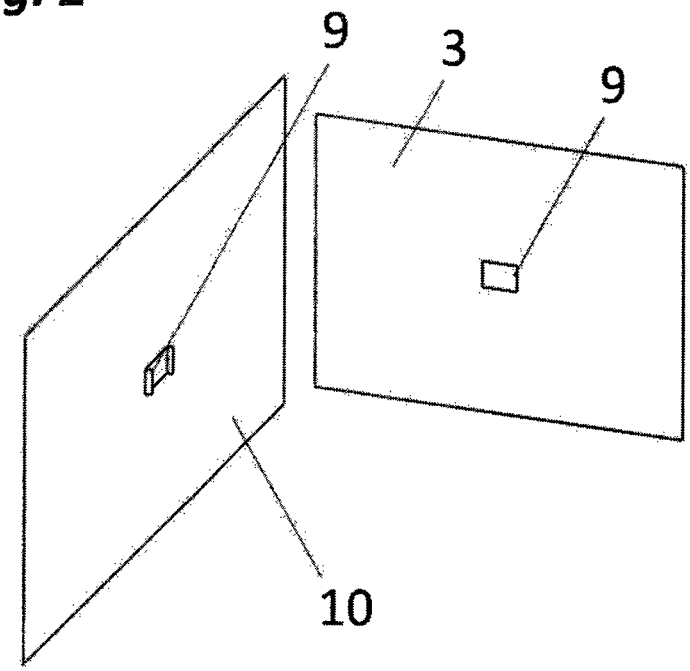
FIG. 2 illustrates the attachment of an ornamental plate to the closing plate.
Figure 3:
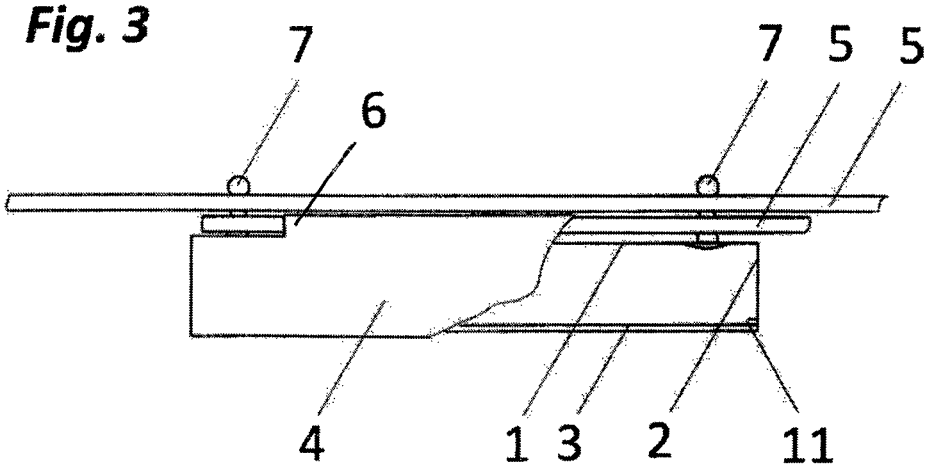
FIG. 3 is a plan view of the container with a belt strap.

In an embodiment, the invention is based on the idea of developing a belt closing connection which can be used without limitation, is equipped with a storage area for debit cards, ornamental replacement plates, or some other content, and still has the advantage that different belt straps and/or ornamental plates can be easily replaced without any use of tools. The container comprises a base plate 1, which is equipped with two belt strap mounting anchors 7, and a frame 2, which is provided with lateral guiding grooves 11, into which a closing plate 3 is slid. Belt strap 5 is now hooked with a belt strap perforated hole 8 in belt strap retaining anchor 7, and closing element 4 is easily slid over the thus resulting container together with belt strap 5 from above. At the same time, this activates belt strap securing tab 6. Closing plate 3 can be equipped with a connecting element 9 to be able to accommodate an ornamental plate 10 and is in turn slid into guiding groove 11 of frame 2.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A belt buckle that is configured to be detached without tools, the belt buckle comprising:

an integrated container for debit cards, identity cards, or driver's license;

the container comprising:

a base plate attached to a belt strap end, the base plate forming a rear surface of the container;

a frame attached to the base plate, the frame forming a bottom surface, a first side surface and a second side surface of the container, the frame being open at an upper end and at a front end thereof;

a closing plate that attaches to the first side surface and the second side surface of the frame to close the open front end of the frame and thus form a front surface of the container; and a closing element that is slid over the base plate, the frame and the closing plate, in a direction from the open upper end of the frame to the bottom surface of the frame, such that the closing element covers the open upper end of the frame, the first side surface of the frame and the second side surface of the frame and at least partially covers the base plate and the closing plate wherein, the closing element has a belt strap securing tab that extends from a rear surface of closing element and reaches behind the belt strap end.

2. The belt buckle according to claim 1, wherein the closing plate is replaceable.

3. The belt buckle according to claim 1, wherein the closing plate has a connecting element arranged on a front face thereof for accommodating an ornamental plate.

4. The belt buckle according to claim 1, further comprising a guiding groove at each of the first side surface and the second side surface of the frame, wherein respective ends of the closing plate are slid into the guiding grooves to thereby attach the closing plate to the first side surface and the second side surface of the frame.

* * * * *

UNITED STATES PATENT AND TRADEMARK OFFICE

CERTIFICATE OF CORRECTION

PATENT NO. : 8,727,193 B2
APPLICATION NO. : 13/845956
DATED : May 20, 2014
INVENTOR(S) : Oelzant It is certified that error appears in the above-identified patent and that said Letters Patent is hereby corrected as shown below:

Title Page

(71) Applicant: Eveline Oelzant, Aalfang/Amaliendorf (AT)

(72) Inventor: Eveline Oelzant, Aalfang/Amaliendorf (AT)

Should read:

(71) Applicant: Eveline Oelzant, Aalfang-Amaliendorf (AT)

(72) Inventor: Eveline Oelzant, Aalfang-Amaliendorf (AT)

Signed and Sealed this
Fifth Day of August, 2014

Michelle K. Lee

Michelle K. Lee
*Deputy Director of the United States Patent and Trademark Office*